US009022910B1

(12) United States Patent
Yehl et al.

(10) Patent No.: US 9,022,910 B1
(45) Date of Patent: May 5, 2015

(54) BALANCE TRAINING DEVICE AND METHOD

(76) Inventors: Willis A. Yehl, Hutto, TX (US); Brian S. Jordan, Hutto, TX (US)

( * ) Notice: Subject to any disclaimer, the term of this patent is extended or adjusted under 35 U.S.C. 154(b) by 2 days.

(21) Appl. No.: 13/459,197

(22) Filed: Apr. 29, 2012

Related U.S. Application Data

(60) Provisional application No. 61/517,995, filed on Apr. 29, 2011.

(51) Int. Cl.

| | |
|---|---|
| ***A63B 26/00*** | (2006.01) |
| ***A63B 9/00*** | (2006.01) |
| ***A63B 7/04*** | (2006.01) |
| ***A63B 4/00*** | (2006.01) |

(52) U.S. Cl.
CPC ..... *A63B 4/00* (2013.01)

(58) Field of Classification Search
CPC ..... A63B 22/00; A63B 23/04; A63B 23/0458
USPC ..... 128/845; 482/23, 37, 51, 52, 140, 142, 482/908
See application file for complete search history.

(56) References Cited

U.S. PATENT DOCUMENTS

| | | | | | |
|---|---|---|---|---|---|
| 1,481,038 | A | * | 1/1924 | Stephenson | 601/121 |
| 3,005,282 | A | * | 10/1961 | Christiansen | 446/128 |
| 3,116,570 | A | * | 1/1964 | Torricelli | 52/436 |
| 3,612,465 | A | * | 10/1971 | Barrett | 52/750 |
| 4,274,824 | A | * | 6/1981 | Mullins | 425/253 |
| 4,390,178 | A | * | 6/1983 | Rudell et al. | 482/77 |
| 4,461,472 | A | * | 7/1984 | Martinez | 482/79 |
| 4,606,732 | A | * | 8/1986 | Lyman | 446/120 |
| 5,197,975 | A | * | 3/1993 | Mombrinie | 606/238 |
| 5,226,868 | A | * | 7/1993 | Montgomery | 482/141 |
| 5,230,195 | A | * | 7/1993 | Sease | 52/592.6 |
| 5,263,863 | A | * | 11/1993 | Stefani et al. | 473/269 |
| 5,453,065 | A | * | 9/1995 | Lien et al. | 482/52 |
| 5,474,509 | A | * | 12/1995 | Hodgdon | 482/52 |

(Continued)

FOREIGN PATENT DOCUMENTS

| | | | | |
|---|---|---|---|---|
| EP | 0300243 | * | 1/1989 | A61G 7/057 |

OTHER PUBLICATIONS

Icepice. "lego sofa." Apr. 12, 2010. <icepice.blogspot.com/2010/04/12-most-creative-unusual-sofa-designs.html>.*

(Continued)

*Primary Examiner* — Stephen Crow
*Assistant Examiner* — Garrett Atkinson
(74) *Attorney, Agent, or Firm* — Gentry McLean PLLC

(57) ABSTRACT

A balance training device is a platform for standing upon that allows inserts with pads to be adjusted and inserted to provide varying degrees of instability. The upper surface of an insert, or pedestal, may include multiple protuberances positioned at or near the periphery of the upper surface and a comparatively lower region between the protuberances and at or near the center of the upper surface. The platform, or base unit, may be configured to support two or more inserts simultaneously, and the inserts may be of differing height or have different numbers of protuberances. A method of balance training includes removably connecting a pedestal to the base unit and standing upon an upper surface of the pedestal. Use of the balance training device may provide improved training safety for participants in group performance activities such as cheerleading.

21 Claims, 6 Drawing Sheets

(56) References Cited

U.S. PATENT DOCUMENTS

| | | | | |
|---|---|---|---|---|
| 5,647,185 | A * | 7/1997 | Forlini | 52/604 |
| 5,651,753 | A * | 7/1997 | Wilkinson | 482/52 |
| 5,772,559 | A * | 6/1998 | Sithole | 482/52 |
| 5,819,743 | A * | 10/1998 | McMillin et al. | 128/845 |
| 5,839,991 | A * | 11/1998 | Hall | 482/23 |
| 5,934,037 | A * | 8/1999 | Bundra | 52/603 |
| 5,954,340 | A * | 9/1999 | Tedesco | 273/450 |
| 6,182,314 | B1 * | 2/2001 | Frydman | 5/648 |
| D441,823 | S | 5/2001 | Blackhurst | |
| 6,648,715 | B2 * | 11/2003 | Wiens et al. | 446/121 |
| 6,945,919 | B2 * | 9/2005 | Yang | 482/142 |
| 7,008,359 | B2 * | 3/2006 | Fan et al. | 482/146 |
| 7,063,646 | B1 * | 6/2006 | Slimi | 482/45 |
| 7,169,099 | B1 | 1/2007 | Kemery et al. | |
| 7,357,766 | B2 * | 4/2008 | Langer et al. | 482/146 |
| 7,694,975 | B1 * | 4/2010 | Darby | 273/450 |
| 7,708,615 | B2 * | 5/2010 | Munch | 446/91 |
| 7,753,831 | B2 * | 7/2010 | Langer et al. | 482/146 |
| 7,824,319 | B2 * | 11/2010 | Carlesimo et al. | 482/141 |
| 8,105,219 | B1 | 1/2012 | Sloan | |
| 8,157,713 | B1 * | 4/2012 | Siskowic et al. | 482/141 |
| 8,176,697 | B1 * | 5/2012 | Bolander, II | 52/309.4 |
| 8,343,022 | B1 | 1/2013 | Sloan | |
| 2001/0016544 | A1 * | 8/2001 | McKechnie et al. | 482/146 |
| 2005/0165450 | A1 * | 7/2005 | Perez-Torrens | 606/240 |
| 2005/0245363 | A1 | 11/2005 | Shumrick | |
| 2006/0014615 | A1 * | 1/2006 | Godbold | 482/141 |
| 2006/0035771 | A1 * | 2/2006 | Gant | 482/141 |
| 2006/0040809 | A1 * | 2/2006 | Godbold | 482/141 |
| 2006/0255545 | A1 * | 11/2006 | Giglia | 273/449 |
| 2009/0193740 | A1 * | 8/2009 | Bennett | 52/309.1 |
| 2012/0131752 | A1 * | 5/2012 | Mason | 5/652.1 |
| 2013/0217545 | A1 * | 8/2013 | Orenstein et al. | 482/52 |

OTHER PUBLICATIONS

More Images from Cheersport in Atlanta!, website blog post, Feb. 11, 2010, pp. 3-4, http://www.confidentcheerleadingblog.com/tag/nfinity/, online.

* cited by examiner

BALANCE TRAINING DEVICE AND METHOD

CROSS-REFERENCE TO RELATED APPLICATIONS

This application claims the benefit of U.S. Provisional Application No. 61/517,995 filed on Apr. 29, 2011.

BACKGROUND OF THE INVENTION

The present invention is in the field of athletic training devices, particularly balance training devices.

In addition to its benefits for overall health and injury prevention, ability to balance is essential to many athletic endeavors. Some activities, such as gymnastics and cheerleading, additionally require participants to maintain balance at a significant elevation above the ground or floor. Loss of balance during such activities is of course particularly hazardous. Cheerleading and other group performance activities may also include the complication that a participant must balance on the relatively irregular surface of a human hand (or pair of hands), shoulder, or other body part (such as an arm, leg, or back). To reduce the hazards associated with training and performance of elevated maneuvers in group performance activities, a training aid providing practice balancing on a relatively unstable surface at a reduced elevation would be desirable.

SUMMARY OF THE INVENTION

The problems described above are substantially solved by a portable device and a method allowing users to practice various strength and balance exercises. The portable device is an apparatus for standing upon using one or both feet. In a preferred embodiment, the apparatus comprises a platform with keyholes which accept a variety of inserts with different functions. On top of each insert, as well as the high point of the platform, is a pad of varying shape to provide instability.

In an embodiment, an apparatus for balance training of a user includes a pedestal dimensioned to underlie a portion of, but less than the entirety of, a foot of the user. An upper surface of the pedestal includes multiple protuberances positioned at or near the periphery of the upper surface and a comparatively lower region between the protuberances and at or near the center of the upper surface. In a further embodiment the upper surface of the pedestal may include four protuberances. Alternatively, the upper surface may include two protuberances. In a preferred embodiment, a height of the pedestal when in use is sufficient to prevent portions of the user's foot not in contact with the pedestal from contacting any surface underlying the pedestal. The pedestal may also be referred to herein as an "insert."

The pedestal may include an upper portion having the upper surface described above and a lower portion supporting the upper portion during use. In an embodiment, the upper portion is formed from a material providing compressibility perceptible to the user. The upper portion may also be referred to herein as a "pad."

The apparatus for balance training may also include a portable base unit dimensioned to underlie an entirety of the foot of the user. The base unit may also be referred to herein as a "platform." In an embodiment, the lower portion of the pedestal is integral to the base unit. In an alternative embodiment, the lower portion of the pedestal is configured to removably connect to the base unit.

In an embodiment with the lower portion of the pedestal configured to removably connect to the base unit, the base unit may include a slot formed in an upper surface, and the lower portion of the pedestal may include a peg dimensioned to fit into the slot. Such a slot may also be referred to herein as a "keyhole," and the peg may also be referred to as a "post." The slot may have a varying width along its length, and the peg on the pedestal may be dimensioned to fit into one or more substantially fixed positions along the length of the slot. In an embodiment, the peg and slot described above may further be dimensioned to allow the pedestal to rotate about a substantially fixed position along the length of the slot.

In addition to a base unit and pedestal, an embodiment of the apparatus may include one or more additional pedestals configured to removably connect to the base unit. The base unit may be configured to support two or more pedestals simultaneously. The two or more pedestals supported by the base unit may be of different heights, and the upper surfaces of the pedestals may include different numbers of protuberances.

In addition to the apparatus described above, a method of balance training is contemplated herein. In an embodiment, the method includes removably connecting a pedestal to a base unit and standing upon an upper surface of the pedestal. The pedestal is dimensioned to underlie a portion of, but less than the entirety of, a foot of the user. An upper surface of the pedestal includes multiple protuberances positioned at or near the periphery of the upper surface and a comparatively lower region between the protuberances and near the center of the upper surface. The base unit is dimensioned to underlie an entirety of the foot of the user.

The method may further include adjusting a position of the pedestal in connection with the base unit. In addition, the method may include removably connecting different pedestals to the base unit to provide varying degrees of instability.

Further aspects of the invention will become apparent from consideration of the drawings and the ensuing description of preferred embodiments of the invention. A person skilled in the art will realize that other embodiments of the invention are possible and that the details of the invention can be modified in a number of respects, all without departing from the inventive concept. Thus, the following drawings and description are to be regarded as illustrative in nature and not restrictive.

BRIEF DESCRIPTION OF THE DRAWINGS

The features of the invention will be better understood by reference to the following detailed description and the accompanying drawings in which.

DETAILED DESCRIPTION OF PREFERRED EMBODIMENTS

Figure 1:
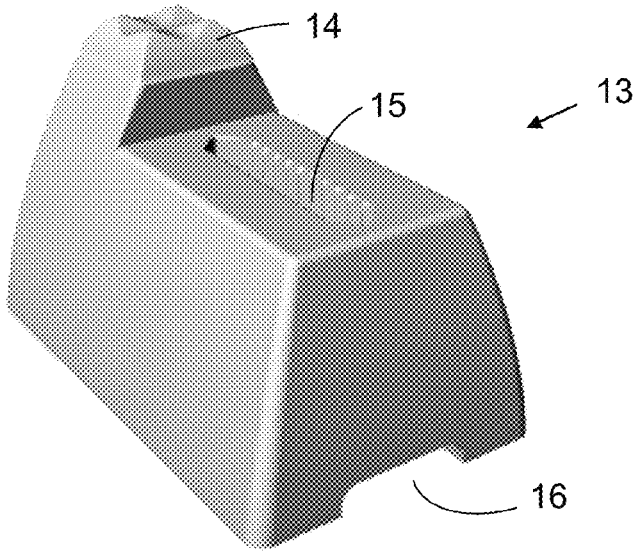
FIG. 1 is a perspective view of the platform of an embodiment of the training apparatus.
Figure 2:
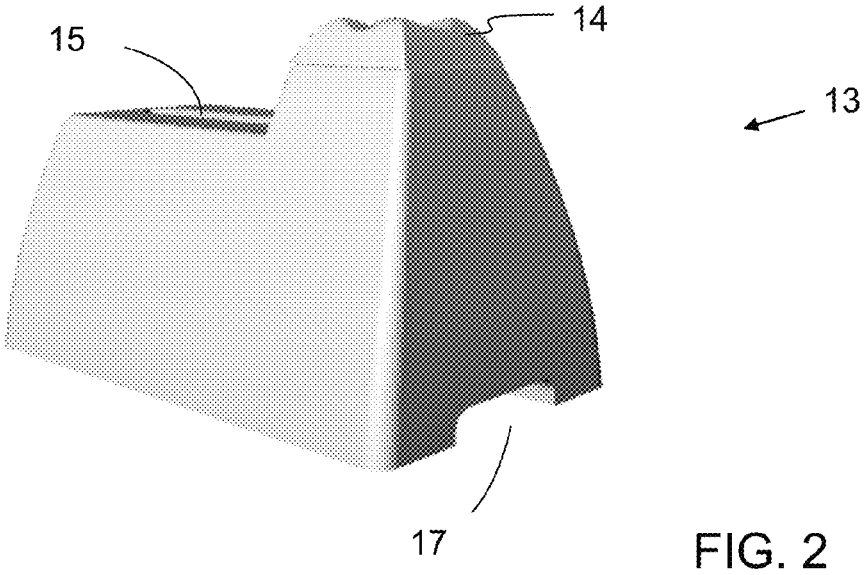
FIG. 2 is a perspective view of the embodiment of FIG. 1.

Referring to the embodiment of FIG. 1 and FIG. 2, there is shown a one piece platform 13 with a pad 14 attached to the top. There is a keyhole 15 in the platform 13 where a variety of inserts as shown in FIG. 3 through FIG. 10 can be arranged. There are also cutouts 16 and 17 at the base of the platform 13 to use as lifting points.

In more detail, still referring to the present embodiment of FIG. 1 and FIG. 2, the top of the platform 13 is sufficiently wide and long to stand on, such as about five inches wide and ten inches long. The bottom of the platform 13 is sufficiently wide and long to provide stability for the platform 13 when standing on, such as about eight inches wide and fourteen inches long. The height of the platform 13 is sufficiently tall to provide a step up off the ground, such as about nine inches high. The pad 14 is sufficiently wide and long to stand on, such as about three to four inches wide and three to four inches long and is about one inch tall. The keyhole 15 is about one inch deep, six to ten inches long, and of a shape that allows a variety of inserts, such as those of FIG. 3 through FIG. 10, to fit precisely.

The construction details of the present embodiment, as shown in FIG. 1 and FIG. 2, are that the platform 13 may be made of high-strength plastic or any other sufficiently rigid and strong material, such as wood, metal and the like. Further, the pad 14 may be made of a rubber like material to yield slightly to the weight of a person standing upon it. The platform, inserts, and pads described throughout this disclosure may be made using any suitable techniques for shaping of these materials into the shapes described herein. For embodiments using plastic or rubberlike materials, for example, the apparatus and its parts may be manufactured by molding techniques known in the art, such as silicon molding or injection molding.

Figure 3:
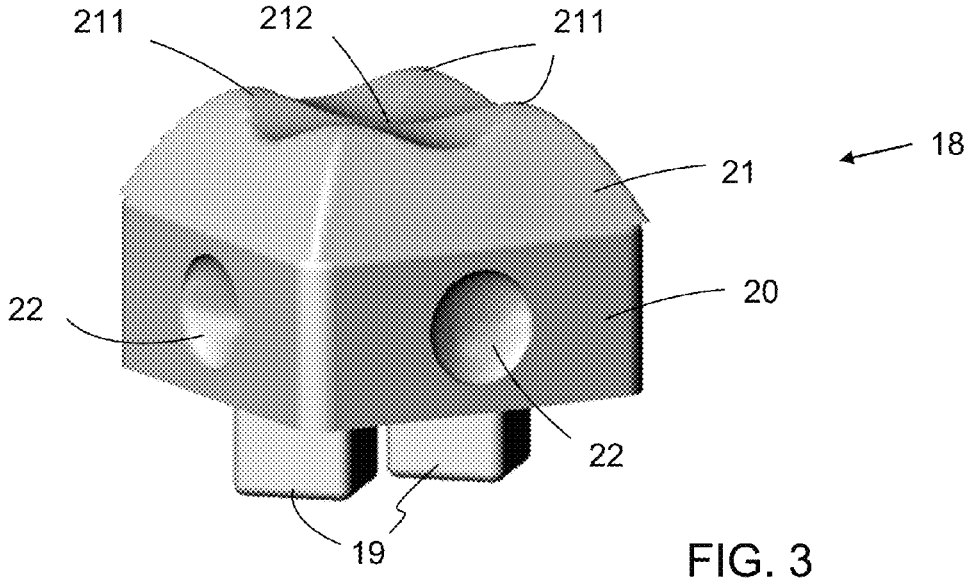
FIG. 3 is a top perspective view of the large insert of an embodiment of the training apparatus.
Figure 4:
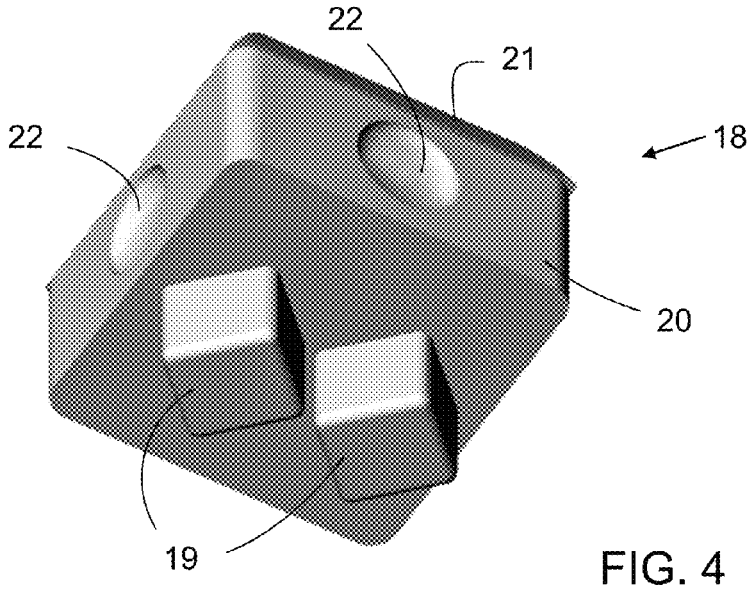
FIG. 4 is a bottom perspective view of the large insert of FIG. 3.

Referring to FIG. 3 and FIG. 4, there is shown a large insert 18 having a lower portion 20 with an upper portion, or pad, 21 attached to the top. Pad 21 is similar to pad 14 of FIGS. 1 and 2. There are posts 19 at the bottom that fit into a number of positions in the keyhole 15 in FIG. 1 and FIG. 2. In this embodiment there are also dimples 22 on each of the four sides to use as finger grips to remove the large insert 18 from the platform 13 in FIG. 1 and FIG. 2.

In more detail, still referring to the present embodiment of FIG. 3 and FIG. 4, the large insert 18 is about three to four inches wide and three to four inches long and about two to three inches tall, which includes the posts 19 that are about one inch tall. The pad 21 is of a size and shape to precisely fit onto the lower portion 20 of the large insert 18 and is about one inch tall. In this embodiment, pad 21 includes four bumps, or protuberances, 211 in its upper surface. Between bumps 211 is a comparatively lower region 212. The unevenness of the upper surface of pad 21 may to some degree simulate for a user of the apparatus the feel of balancing on the palm of a human hand. Together, the lower portion 20 and the pad 21, when inserted in the keyhole 15 of FIG. 1 and FIG. 2, are sufficiently tall enough to be level with the pad 14 in FIG. 1 and FIG. 2 and provide a level surface on which to stand.

The construction details of the present embodiment, as shown in FIG. 3 and FIG. 4, are that the large insert 18 may be made of high-strength plastic or any other sufficiently rigid and strong material such as wood, metal and the like. Further, the pad 21 may be made of a rubber like material to yield slightly to the weight of a person standing upon it.

Figure 5:
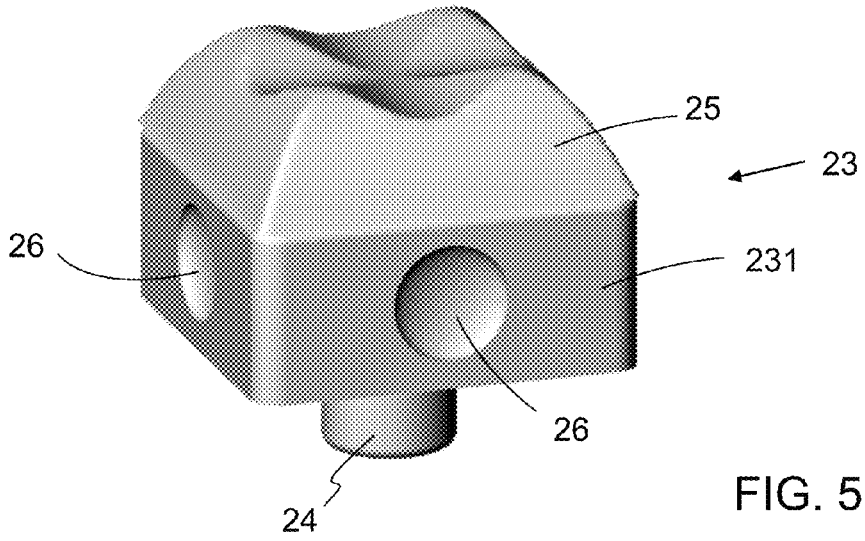
FIG. 5 is a top perspective view of the rotating insert of an embodiment of the training apparatus.
Figure 6:
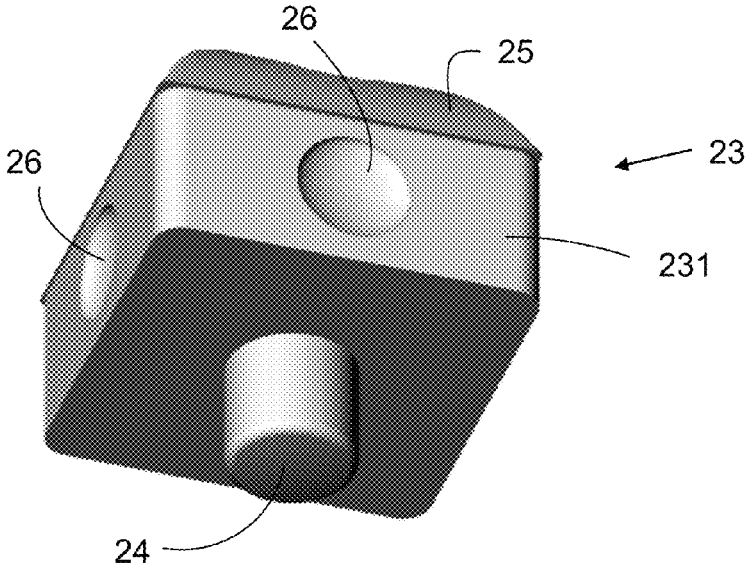
FIG. 6 is a bottom perspective view of the rotating insert of FIG. 5.

Referring to FIG. 5 and FIG. 6, there is shown a rotating insert 23 having a lower portion 231 with a pad 25 attached to the top. In this embodiment, pad 25 is similar to pad 21 of FIGS. 3 and 4. There is round post 24 at the bottom that fits into a number of positions in the keyhole 15 in FIG. 1 and FIG. 2. There are also dimples 26 on each of the four sides to use as finger grips to remove the rotating insert 23 from the platform 13 in FIG. 1 and FIG. 2.

In more detail, still referring to the present embodiment of FIG. 5 and FIG. 6, the lower portion 231 of rotating insert 23 is about three to four inches wide and three to four inches long and about two to three inches tall, which includes the round post 24 that is about one inch tall. The pad 25 is of a size and shape to precisely fit onto the lower portion 231 of the rotating insert 23 and is about one inch tall. Together, the lower portion 231 and the pad 25, when inserted in the keyhole 15 of FIG. 1 and FIG. 2, are sufficiently tall enough to be level with the pad 14 in FIG. 1 and FIG. 2 and provide a level surface on which to stand.

The construction details of the present embodiment, as shown in FIG. 5 and FIG. 6, are that the rotating insert 23 may be made of high-strength plastic or any other sufficiently rigid and strong material such as wood, metal and the like. Further, the pad 25 may be made of a rubber like material to yield slightly to the weight of a person standing upon it.

Figure 7:
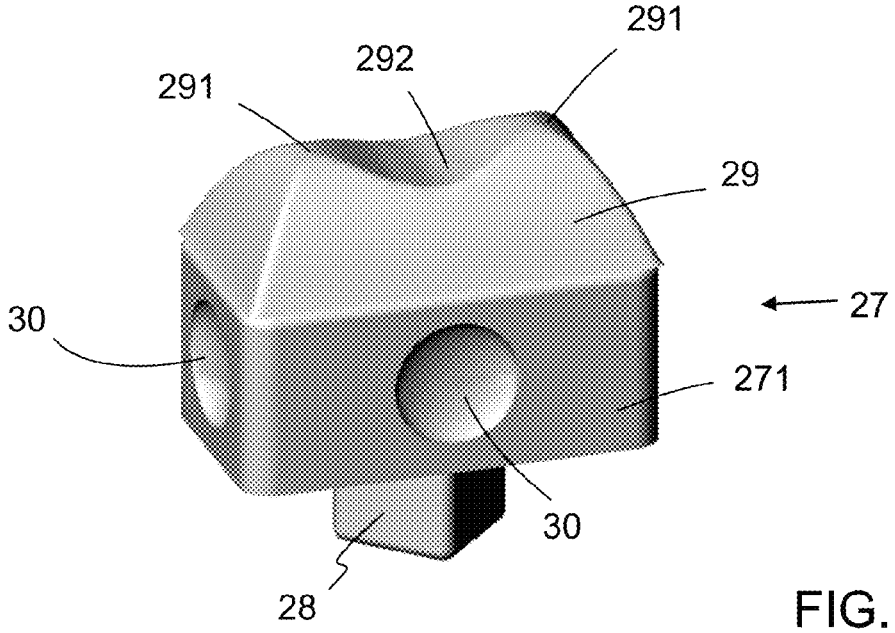
FIG. 7 is a top perspective view of the medium insert of an embodiment of the training apparatus.
Figure 8:
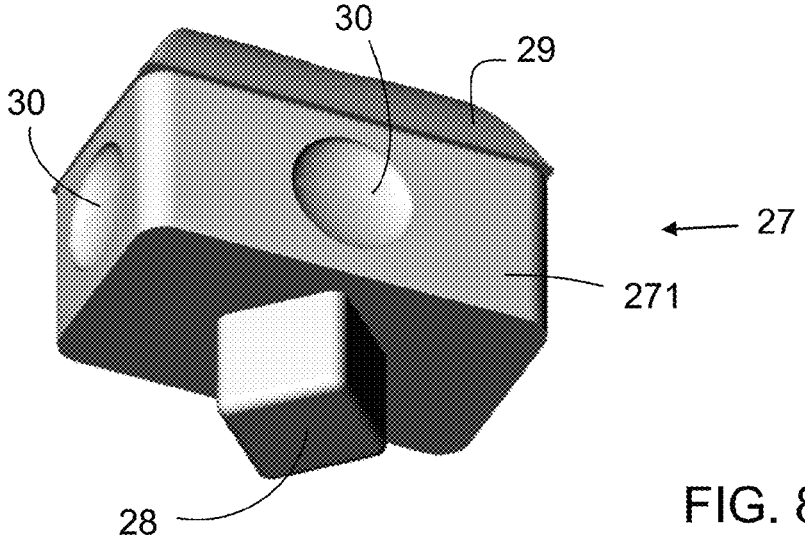
FIG. 8 is a bottom perspective view of the medium insert of FIG. 7.

Referring to FIG. 7 and FIG. 8, there is shown a medium insert 27 having a lower portion 271 with a pad 29 attached to the top. In this embodiment, pad 29 is similar to pad 21 of FIGS. 3-4 or pad 25 of FIGS. 5-6, but includes two bumps or protuberances 291 rather than four, with a comparatively lower region 292 between bumps 291. There is a post 28 at the bottom that fits into a number of positions in the keyhole 15 in FIG. 1 and FIG. 2. There are also dimples 30 on each of the four sides to use as finger grips to remove the medium insert 27 from the platform 13 in FIG. 1 and FIG. 2.

In more detail, still referring to the present embodiment of FIG. 7 and FIG. 8, the lower portion 271 of medium insert 27 is about three to four inches wide and one to two inches long and about two to three inches tall, which includes the post 28 that is about 1 inch tall. The pad 29 is of a size and shape to precisely fit onto the lower portion 271 of medium insert 18 and is about 1 inch tall. Together, the lower portion 271 and the pad 29, when inserted in the keyhole 15 of FIG. 1 and FIG. 2, are sufficiently tall enough to be level with the pad 14 in FIG. 1 and FIG. 2 and provide a level surface on which to stand.

The construction details of the present embodiment, as shown in FIG. 7 and FIG. 8, are that the medium insert 27 may be made of high-strength plastic or any other sufficiently rigid and strong material such as wood, metal and the like. Further, the pad 29 may be made of a rubber like material to yield slightly to the weight of a person standing upon it.

Figure 9:
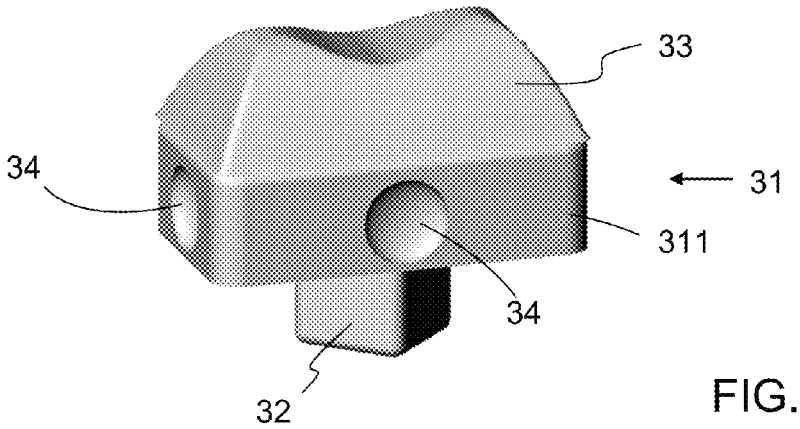
FIG. 9 is a top perspective view of the small insert of an embodiment of the training apparatus.
Figure 10:
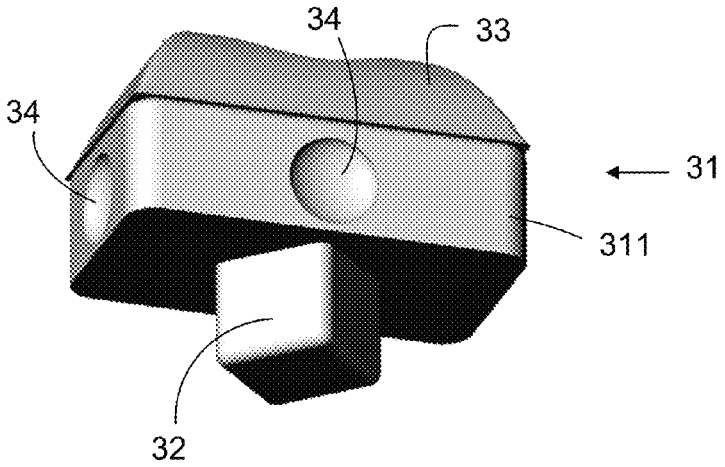
FIG. 10 is a bottom perspective view of the small insert of FIG. 9.

Referring to FIG. 9 and FIG. 10, there is shown a small insert 31 having a lower portion 311 with a pad 33 attached to the top. In this embodiment, pad 33 is similar to pad 29 of FIGS. 7 and 8. There is a post 32 at the bottom that fits into a number of positions in the keyhole 15 in FIG. 1 and FIG. 2. There are also dimples 34 on each of the four sides to use as finger grips to remove the small insert 31 from the platform 13 in FIG. 1 and FIG. 2.

In more detail, still referring to the present embodiment of FIG. 9 and FIG. 10, the lower portion 311 of the small insert 31 is about three to four inches wide and one to two inches long and about two inches tall, which includes the post 32 that is about one inch tall. The pad 33 is of a size and shape to precisely fit onto the small insert 31 and is about one inch tall. Together, the lower portion 311 and the pad 33, when inserted in the keyhole 15 of FIG. 1 and FIG. 2, are shorter than the pad 14 in FIG. 1 and FIG. 2 and provide an unlevel surface on which to stand.

The construction details of the present embodiment, as shown in FIG. 9 and FIG. 10, are that the small insert 31 may be made of high-strength plastic or any other sufficiently rigid and strong material such as wood, metal and the like. Further, the pad 33 may be made of a rubber like material to yield slightly to the weight of a person standing upon it.

Figure 11:
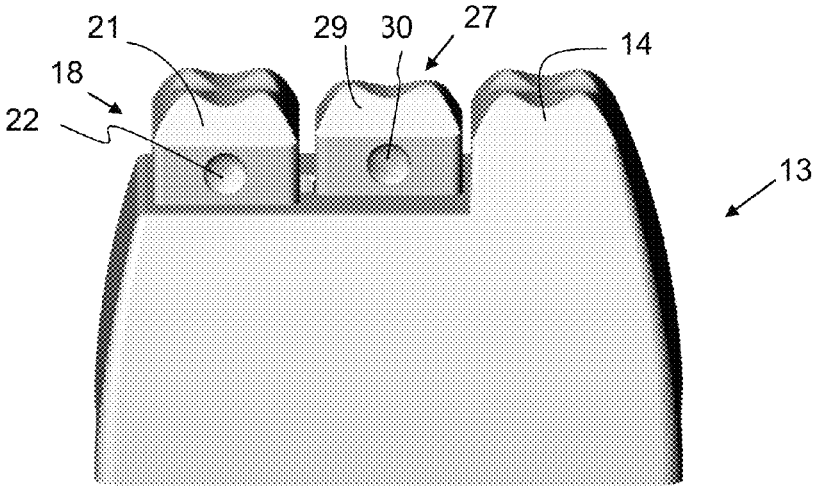
FIG. 11 is a perspective view of the platform of the embodiment of FIG. 1 with the medium insert of FIG. 7 and the large insert of FIG. 3 in place.
Figure 12:
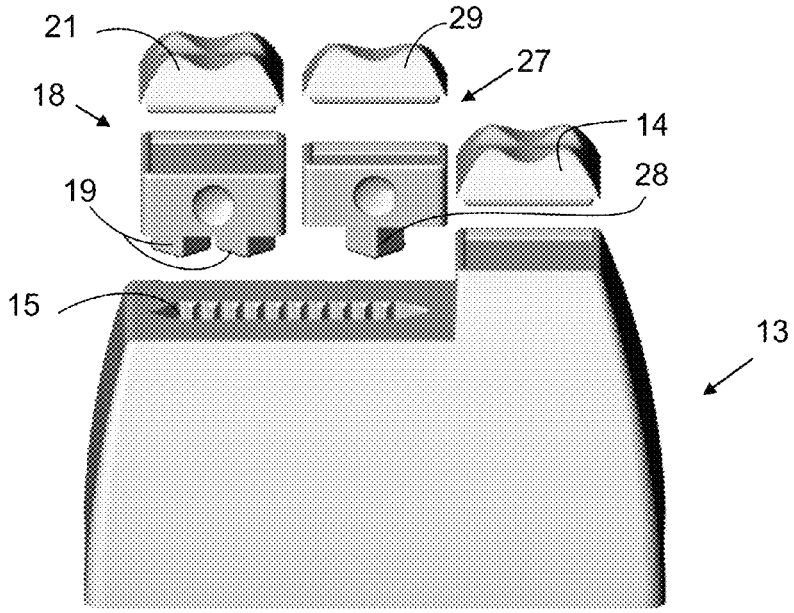
FIG. 12 is an exploded view of the embodiment of FIG. 11.

Referring to FIG. 11 and FIG. 12, with FIG. 12 being an exploded view of FIG. 11, there is shown the platform 13 of FIG. 1 and FIG. 2 with the large insert 18 of FIG. 3 and FIG. 4 and the medium insert 27 of FIG. 7 and FIG. 8 in one possible configuration.

Many variations of the invention will occur to those skilled in the art. For example, inserts or pedestals such as inserts 18, 23, 27, and 31 shown in the figures could be formed as a single piece rather than with separate upper and lower portions. Some variations call for platform 13 being different shapes and styles including different permanent high and low points, a surface with only keyholes 15 for inserts 18, 23, 27, 31 and non-flat bottom surfaces to allow instability. Other variations call for platform 13 to be formed from two or more parts to vary height and ease portability. Other variations include the entire device moving, shaking or raising and lowering by mechanical and electrical means. Other variations include larger and smaller versions, with varying densities of materials and shapes for the pads 14, 21, 25, 29, 33. Still other variations include additional inserts of varying size and shape for different balancing objectives. Other variations include different adjustment methods, sliding or rotating inserts and shapes of the keyholes 15. Other variations call for LED or other forms of lights, pressure point sensors, digital displays, audio speakers, microphones with voice recognition, data entry points, pliable and or traction material on the bottom surface and straps or connections to attach the device to ones feet.

Although the present embodiment is shown to include certain features, the applicants specifically contemplate that any feature disclosed herein may be used together or in combination with any other feature on any embodiment of the invention. It is also contemplated that any feature may be specifically excluded from any embodiment of the invention.

While the foregoing written description of the invention enables one of ordinary skill to make and use what is considered presently to be the best mode thereof, those of ordinary skill will understand and appreciate the existence of variations, combinations, and equivalents of the specific embodiment and examples herein. The invention should therefore not be limited by the above described embodiment and examples, but by all embodiments and methods within the scope and spirit of the invention.

What is claimed is:

1. An apparatus for balance training, said apparatus comprising:

a pedestal adapted to underlie a portion of a foot of a user standing on the pedestal, wherein an uppermost surface of the pedestal when in use includes multiple protuberances positioned at or near a periphery of the uppermost surface and a comparatively lower region situated between the protuberances and at or near a center of the uppermost surface, wherein the pedestal comprises an upper portion including the uppermost surface and a lower portion supporting the upper portion during use of the pedestal and wherein said multiple protuberances are adapted to underlie and provide additional instability to the portion of the foot of the user standing on the pedestal; and a portable base unit adapted to underlie an entirety of the foot of the user, wherein the base unit includes a slot formed in an uppermost surface, the slot comprising an opening in the plane of the uppermost surface, the opening comprising a length and a width in the plane of the uppermost surface, the length is greater than the width, and the lower portion of the pedestal includes a peg dimensioned to fit into the slot through the opening, wherein the width of the opening varies along the length of the opening, and wherein the peg is dimensioned to fit into one of multiple substantially fixed positions along the length of the opening such that the pedestal is longitudinally static.

2. The apparatus of claim 1, wherein the uppermost surface of the pedestal includes four protuberances.

3. The apparatus of claim 1, wherein the uppermost surface of the pedestal includes two protuberances.

4. The apparatus of claim 1, wherein a height of the pedestal when in use is sufficient to prevent portions of the user's foot not in contact with the uppermost surface of the pedestal from contacting any surface underlying the pedestal.

5. The apparatus of claim 1, wherein the upper portion comprises a compressible material.

6. The apparatus of claim 1, wherein the lower portion of the pedestal is integral to the base unit.

7. The apparatus of claim 1 wherein the lower portion of the pedestal is configured to removably connect to the base unit.

8. The apparatus of claim 1, wherein the peg and slot are dimensioned to allow the pedestal to rotate about a substantially fixed position along the length of the opening.

9. The apparatus of claim 7, further comprising one or more additional pedestals configured to removably connect to the base unit, and wherein the base unit is configured to support two or more pedestals simultaneously.

10. The apparatus of claim 9, wherein the two or more pedestals are of differing height.

11. The apparatus of claim 9, wherein uppermost surfaces of the two or more pedestals during use include different numbers of protuberances.

12. The apparatus of claim 1, further comprising one or more additional pedestals configured to removably connect to the base unit, and wherein the base unit is configured to support two or more pedestals simultaneously.

13. The apparatus of claim 12, wherein the two or more pedestals are of differing height.

14. The apparatus of claim 12, wherein uppermost surfaces of the two or more pedestals include different numbers of protuberances.

15. A method of balance training, said method comprising:

removably connecting a pedestal to a base unit; and standing upon an uppermost surface of the pedestal, wherein:

the pedestal is adapted to underlie a portion of a foot of a user standing on the pedestal, the uppermost surface of the pedestal includes multiple protuberances positioned at or near a periphery of the uppermost surface and a comparatively lower region situated between the protuberances and at or near a center of the uppermost surface, the base unit includes a slot formed in an uppermost surface, the slot comprising an opening in the plane of the uppermost surface, the opening comprising a length and a width in the plane of the uppermost surface, the length is greater than the width, the lower portion of the pedestal includes a peg dimensioned to fit into the slot through the opening, the width of the opening varies along the length of the opening, the peg is dimensioned to fit into one of multiple substantially fixed positions along the length of the opening such that the pedestal is longitudinally static, said multiple protuberances are adapted to underlie and provide additional instability to the portion of the foot of the user standing on the pedestal, and the base unit is adapted to underlie an entirety of the foot of the user.

16. The method of claim 15, further comprising adjusting a position of the pedestal in connection with the base unit.

17. The method of claim 15, further comprising removably connecting different pedestals to the base unit to provide varying degrees of instability.

18. The method of claim 15, wherein the largest diameter of the periphery of the uppermost surface is no larger than six inches.

19. The method of claim 15, wherein the largest diameter of the periphery of the uppermost surface is between about three inches and about six inches.

20. The method of claim 18, wherein the largest diameter of the periphery of the uppermost surface is between three inches and six inches.

21. An apparatus for balance training, said apparatus comprising a pedestal adapted to underlie a portion of a foot of a user standing on the pedestal, wherein an uppermost surface of the pedestal when in use includes multiple protuberances positioned at or near a periphery of the uppermost surface and a comparatively lower region situated between the protuberances and at or near a center of the uppermost surface, the apparatus further comprising a portable base unit adapted to underlie an entirety of the foot of the user, wherein the base unit includes a slot formed in an uppermost surface, the slot comprising an opening in the plane of the uppermost surface, the opening comprising a length and a width in the plane of the uppermost surface, the length is greater than the width, and a lower portion of the pedestal includes a peg dimensioned to fit into the slot through the opening, wherein the width of the opening varies along the length of the opening, and wherein the peg is dimensioned to fit into one of multiple substantially fixed positions along the length of the opening such that the pedestal is longitudinally static, and wherein said multiple protuberances are adapted to underlie and provide additional instability to the portion of the foot of the user standing on the pedestal.

* * * * *